US007861990B2

(12) United States Patent
Barnes

(10) Patent No.: US 7,861,990 B2
(45) Date of Patent: Jan. 4, 2011

(54) COMBINATION AWNING BRACKET AND LIGHT SUPPORT SYSTEM

(76) Inventor: Michael S. Barnes, 8540 Cobb Center Dr., Suite 100, Kennesaw, GA (US) 30152

( * ) Notice: Subject to any disclaimer, the term of this patent is extended or adjusted under 35 U.S.C. 154(b) by 423 days.

(21) Appl. No.: 11/948,986

(22) Filed: Nov. 30, 2007

(65) Prior Publication Data

US 2008/0067304 A1 Mar. 20, 2008

Related U.S. Application Data

(63) Continuation-in-part of application No. 11/267,617, filed on Nov. 7, 2005, now abandoned, which is a continuation-in-part of application No. 11/200,464, filed on Aug. 10, 2005, now Pat. No. 7,311,290.

(51) Int. Cl.
*A47H 1/10* (2006.01)

(52) U.S. Cl. ..... 248/273; 248/201; 248/251; 248/48.2; 52/74; 52/75

(58) Field of Classification Search ..... 248/301, 248/200, 201, 205.1, 236, 235, 247, 248, 248/249, 250, 251, 252, 254, 255, 253, 261, 248/262, 263, 266, 267, 273, 304, 309.1, 248/311.2, 312.1, 65, 68.1, 256, 268, 48.1, 248/48.2, 345; 52/74, 75, 76, 77, 78; D25/57, D25/68

See application file for complete search history.

(56) References Cited

U.S. PATENT DOCUMENTS

| | | | |
|---|---|---|---|
| 167,422 | A | 9/1875 | Abbott |
| D30,108 | S | 1/1899 | Heib |
| 848,950 | A | 4/1907 | Wyler |
| 891,406 | A | 6/1908 | Cassens |
| 909,353 | A | 1/1909 | White |
| 1,021,330 | A | 3/1912 | Price |
| 1,206,203 | A | 11/1916 | Brockway |
| 1,454,557 | A | 5/1923 | Nietzel |
| 1,541,774 | A | 6/1925 | Kuziel |
| 1,568,538 | A | 1/1926 | Argo |
| 1,795,657 | A | 3/1931 | Madvig |
| 2,138,507 | A | 11/1938 | Pisciotta |
| 2,293,662 | A | 8/1942 | Richardson |
| 2,354,404 | A | 7/1944 | Sayles |
| 2,655,336 | A | 10/1953 | McGowan |
| 2,682,689 | A | 7/1954 | Helt |
| 2,685,716 | A | 8/1954 | Evans |

(Continued)

*Primary Examiner*—Terrell Mckinnon
*Assistant Examiner*—Bradley H Duckworth
(74) *Attorney, Agent, or Firm*—Kirton & McConkie; Michael F. Krieger; Adam D. Stevens

(57) ABSTRACT

Components for constructing and installing an awning and light support system to provide sun and weather protection to a window or door of a structure are disclosed. Included are a pair of uniquely-constructed bracket members having an L-shaped configuration used to removably secure horizontally-disposed supports and awning spars to provide a frame to support the awning material or skin. Also disclosed is an awning support structure comprising a support channel that extends along the top of an awning and supports a corresponding member attached to an awning frame. In some instances, the awning may be further supported by awning projection props secured between the awning frame and the building at a lower portion of the awning.

25 Claims, 16 Drawing Sheets

U.S. PATENT DOCUMENTS

| | | | | |
|---|---|---|---|---|
| 2,799,464 | A | | 7/1957 | D'Azzo |
| 2,890,853 | A | | 6/1959 | D'Azzo |
| 3,333,803 | A | | 8/1967 | Landis |
| 3,364,973 | A | | 1/1968 | Railson |
| 3,651,850 | A | | 3/1972 | Raymond |
| 3,851,848 | A | | 12/1974 | Wiele |
| 3,900,110 | A | | 8/1975 | Soroka |
| 3,923,074 | A | | 12/1975 | McKee |
| 3,949,960 | A | | 4/1976 | McKee |
| 4,000,587 | A | | 1/1977 | Weber |
| 4,192,112 | A | | 3/1980 | Reilly, Sr. |
| D285,529 | S | | 9/1986 | Huhold et al. |
| 4,854,363 | A | * | 8/1989 | Fouquet ..... 160/98 |
| 5,148,849 | A | | 9/1992 | Faludy |
| 5,197,797 | A | | 3/1993 | Jaksich |
| 5,394,921 | A | | 3/1995 | Lohausen |
| 6,273,385 | B1 | | 8/2001 | Hambleton |
| 6,301,836 | B1 | | 10/2001 | Richardson |
| 6,457,688 | B1 | | 10/2002 | Welfonder |
| 6,494,246 | B1 | * | 12/2002 | Blevins ..... 160/67 |
| 6,739,371 | B2 | | 5/2004 | Mukai |
| 6,935,074 | B2 | | 8/2005 | Gramling |
| 6,968,651 | B2 | | 11/2005 | Bergeron |
| 2006/0157629 | A1 | | 7/2006 | Silverman |

* cited by examiner

COMBINATION AWNING BRACKET AND LIGHT SUPPORT SYSTEM

CROSS-REFERENCE TO RELATED APPLICATIONS

This application is a continuation-in-part of prior U.S. application Ser. No. 11/267,617, filed Nov. 7, 2005, now abandoned which is a continuation-in-part of prior U.S. application Ser. No. 11/200,464, filed Aug. 10, 2005 now U.S. Pat. No. 7,311,290.

BACKGROUND OF THE INVENTION

1. Field of the Invention

This invention is directed to the field of awning support systems, such as may be used in shading windows, doors, and the like, and more particularly to readily-mounted support systems and awning frame assembly members, where the systems may be readily handled and installed by a single installer or handyman.

2. Background and Related Art

The present invention relates to easily-installed awning systems, where the systems may be readily handled by a single installer.

Typically, prior art systems are constructed of a single unit, though the unit includes supporting brackets, the awning cover and awning side members. The unit is usually shipped to the installation site, where installation often requires special skills, and once installed is difficult to remove. Finally, such prior art systems are not adjustable or flexible to fit different sized windows and doors.

Further prior art systems are taught in the patented art as reflected in the following U.S. patents:

a.) U.S. Pat. No. 3,949,960, to McKee, discloses a bracket system for mounting the box or housing of retractable roll-up awnings on curved or straight sides of recreational vehicles. The bracket system includes a generally L-shaped mounting bracket for supporting the awning housing, bracket clamps for securing the housing to the mounting bracket, and an adapter bracket for supporting the mounting bracket on a variety of curved sloping surfaces such as exterior walls of recreational vehicles. The bracket clamp engages with the mounting bracket by means of a dovetail mortise and tenon joint while the awning housing is secured to the mounting bracket and bracket clamp by tongue and groove engagement. The mounting bracket is supported on the adapter bracket by a keyhole mortise and tenon joint in cooperation with a tongue and groove joint. The adapter bracket is designed to provide a plurality of mounting positions in order to accommodate the mounting bracket to a wide variety of curved walls or surfaces on recreational vehicles.

b.) U.S. Pat. No. 4,192,112, to Reilly, Sr., teaches a pliable awning system consisting of a head bar means adapted to be mounted on a building and the like for support and a front bar means adapted to be mounted on posts and the like with a pliable awning extending between the building and the posts; the awning having securing means fastened to both ends for securing said awning to said head bar means and said front bar means with adjustable means mounted on the front bar means for rendering the pliable awning taut.

c.) U.S. Pat. No. 5,148,849, to Faludy, is directed to a lighted retractable awning that includes a roll bar about which a canopy can be rolled with the roll bar having an elongated recess therein adapted to receive a light source. The light source includes an electrical cord having a plug on one end adapted to be received in an electrical outlet in a support surface on which the awning is mounted.

d.) U.S. Pat. No. 5,197,797, to Jaksich, relates to an elongated transparent lighting fixture having an open ended tubular housing formed with an interior chamber for telescopic receipt of an elongated channel shaped rail formed having opposed in-turned longitudinal flanges defining therebetween passageways. A plurality of L-shaped mounting brackets are configured with respective horizontally disposed foot plates, the opposite marginal edges thereof forming sliders received slidably under the rail flanges. The opposite leg of the respective brackets then form vertically-projecting mounting plates which mount respective sockets for receipt of the opposite ends of tubular electrical lamps to mount them with the bottom peripheral segments thereof recessed into said passageway. One mounting bracket is formed with an elongated strip disposed in heat exchange relationship with heat emitting electrical components to provide for efficient transfer to the channel which will act as a heat sink.

e.) U.S. Pat. No. 6,739,371, to Mukai, discloses an awning installing device that includes a main body having first and second opposing major surfaces, with a given width and appropriate thickness and length. The first major surface is adapted to be brought into contact with a façade wall onto which an awning is to be installed, and the awning is to be mounted on the second major surface. A groove is formed in the main body to open at the second major surface and extend along the entire length of the main body. A bracket for supporting the awning has a portion which is movable in and along the groove to a desired location where it can be fixed. The main body is provided with a plurality of securing holes. Screws can be screwed through selected ones of the securing holes into the wall for securing the main body. End securing members which close both ends of the groove are used to secure the ends of the main body to walls extending perpendicularly to the façade wall.

Unfortunately, the commercial systems, and those of the above noted prior art, fail to provide a suitable awning and light support system that can be readily installed by a week end do-it-yourself handyman in the manner of the embodiments of the present invention. The system hereof and the manner by which such support system may be easily installed will become more apparent in the description and drawings which follow.

BRIEF SUMMARY OF THE INVENTION

Embodiments of the invention relate to an awning and light support systems, and to kits of components, to provide for the easy installation of sun and rain protection to an opening, such as one or more windows or doors, of a structure. One system and kit of components comprises a pair of L-shaped bracket members for mounting at respective sides of the structure's selected opening(s), and a pair of uniquely-constructed, horizontal awning support members. Each of the bracket members comprises a first vertically-oriented leg with means for removably attaching the bracket member to the structure, and a second horizontally-oriented leg joined to said first leg. The respective arms include remote free ends that may exhibit an L-shaped configuration for removably securing horizontal awning support member attached to an awning spar.

Additionally, each bracket member may include a horizontally-directed arm extending perpendicularly from the first vertically-oriented leg in the plane of the bracket member for mounting a light fixture. Fasteners may be used to conveniently anchor the bracket members to the structure. The horizontal awning support members, one along the top and one along the bottom of the L-shaped bracket member, comprises a first aluminum extrusion member and a second aluminum extrusion member, connecting block, or attachment block for snugly seating in the first extrusion member for securing the awning spar.

Alternate embodiments of the invention relate to an easily-installed system that includes a nested support structure and awning projection props. Some embodiments of the invention utilize a new frame assembly system, including the nested horizontal extrusion members.

Accordingly, a feature of some embodiments of the invention is an awning and light support system consisting of a pair of brackets that can be readily installed by a do-it-yourself handyman. Other features of embodiments of the awning and light support system are the provision of a support bracket that includes means for mounting a light fixture, and the use of uniquely-constructed horizontal awning support members that may be extrusions.

A further feature of embodiments thereof is an awning and light support system, through a simple kit of components, that may be easily installed by a single person.

These and other features of the invention will become clearer in the following specification, particularly when read in conjunction with the accompanying drawings.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
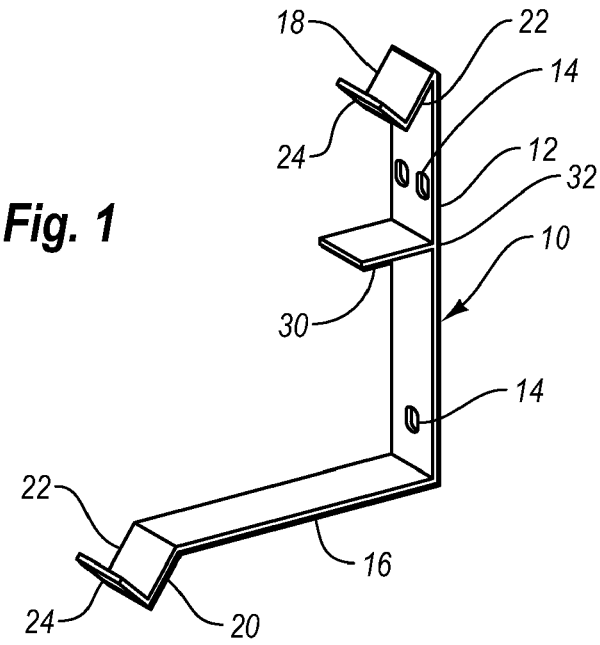
FIG. 1 is a perspective view of an embodiment of an awning bracket according to embodiments of the invention.
Figure 2:
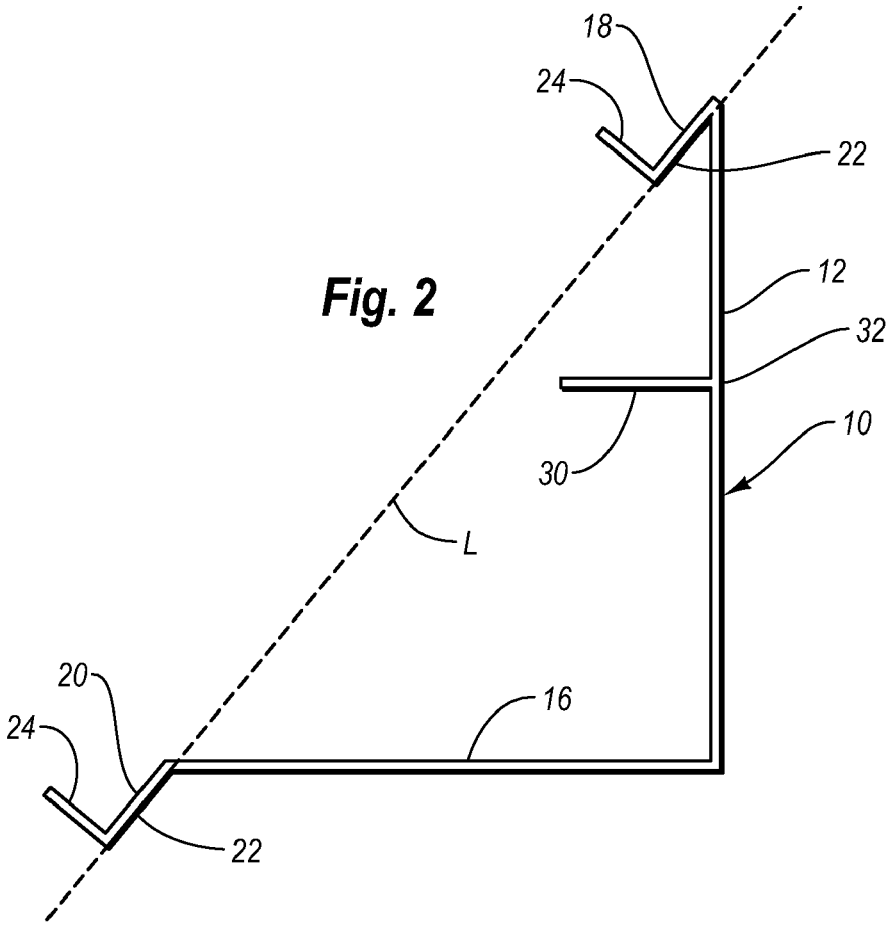
FIG. 2 is a side view of the awning bracket illustrated in FIG. 1.
Figure 3:
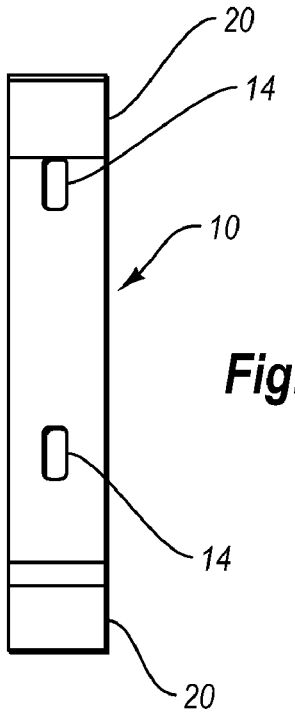
FIG. 3 is a rear view of the awning bracket of FIG. 1.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention are directed to awning and light support systems, and kits of components, of the type to provide sun and rain protection to a window or door of a structure. More particularly some embodiments of the invention relate to an easily-installed system that includes a pair of uniquely constructed L-shaped bracket members for mounting to the respective sides of the window or door. Alternate embodiments of the invention relate to an easily-installed system that includes a nested support structure and awning projection props. Embodiments of the invention also utilize a new frame assembly system. The details of the various systems will become clearer in the following description and accompanying drawings, where like reference numerals represent like components or features throughout the several views.

Turning now to FIGS. 1-4, illustrating different views of a uniquely constructed bracket member of this invention, FIG. 1 shows an L-shaped bracket member 10. The bracket member 10, one of a pair of brackets that may be removably secured at the respective sides of a window or door, comprises a vertically-oriented leg 12, containing plural fastener-receiving apertures 14 for mounting such leg 12 proximate to a structure by lag bolts or other suitable fasteners as known in the art. Joined to and perpendicular thereto is a horizontally-oriented leg 16.

Figure 4:
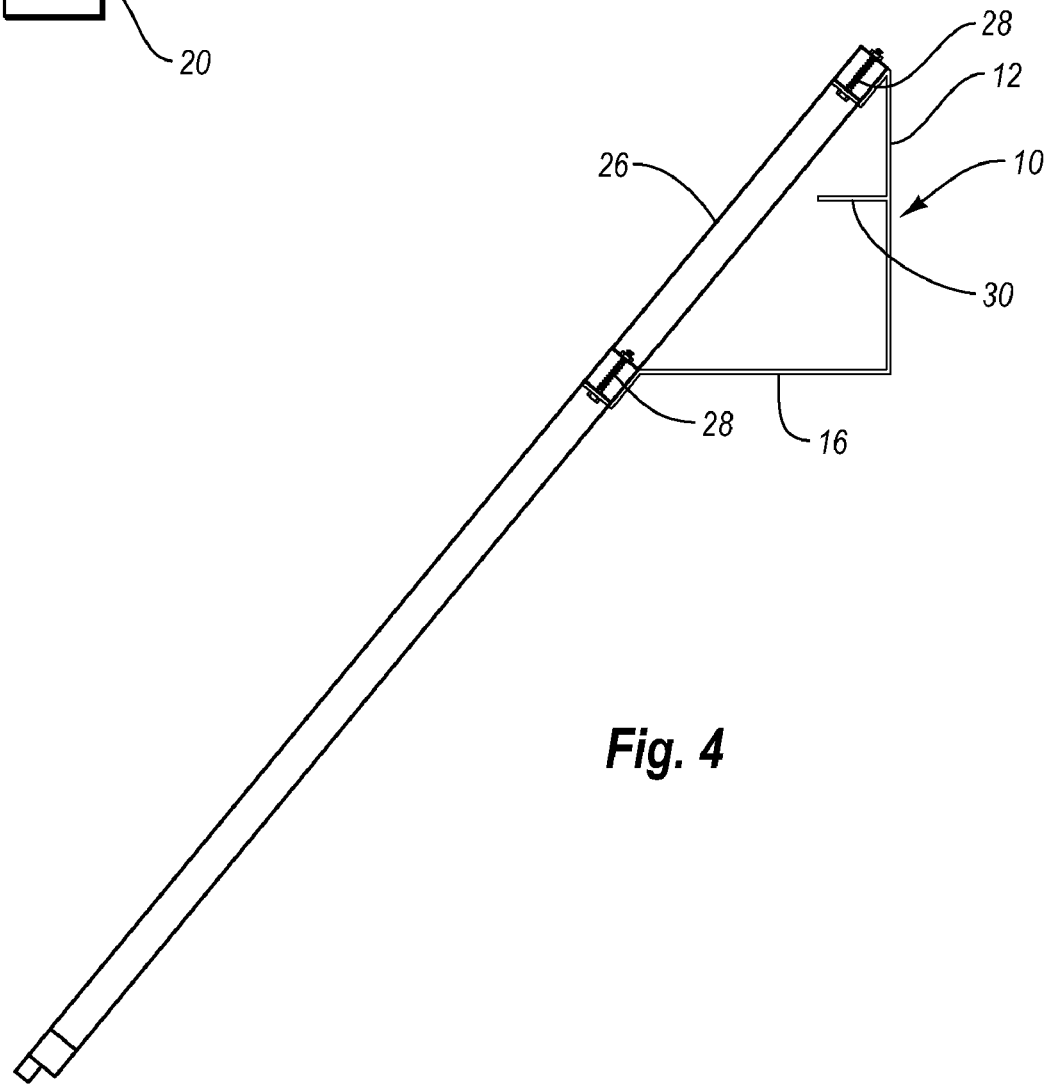
FIG. 4 is a further side plan view of the awning bracket of FIG. 1, showing the bracket in a supporting relationship to an angled awning.
Figure 7:
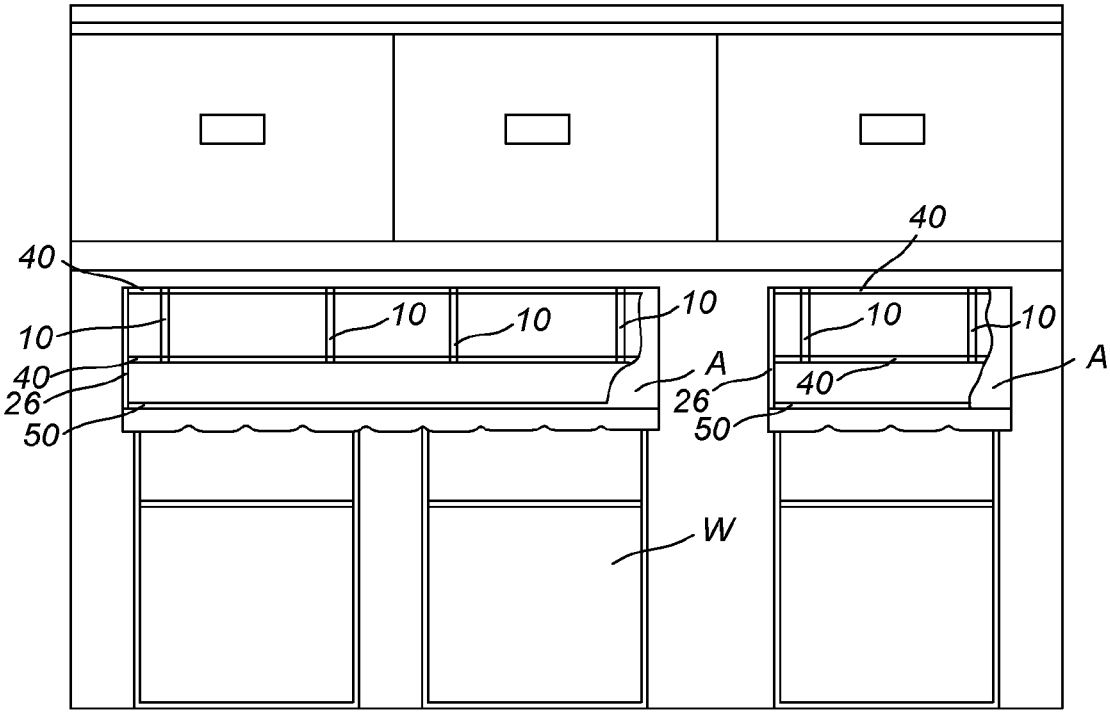
FIG. 7 is a front plan view showing plural awning brackets positioned for supporting a pair of awnings.
Figure 8:
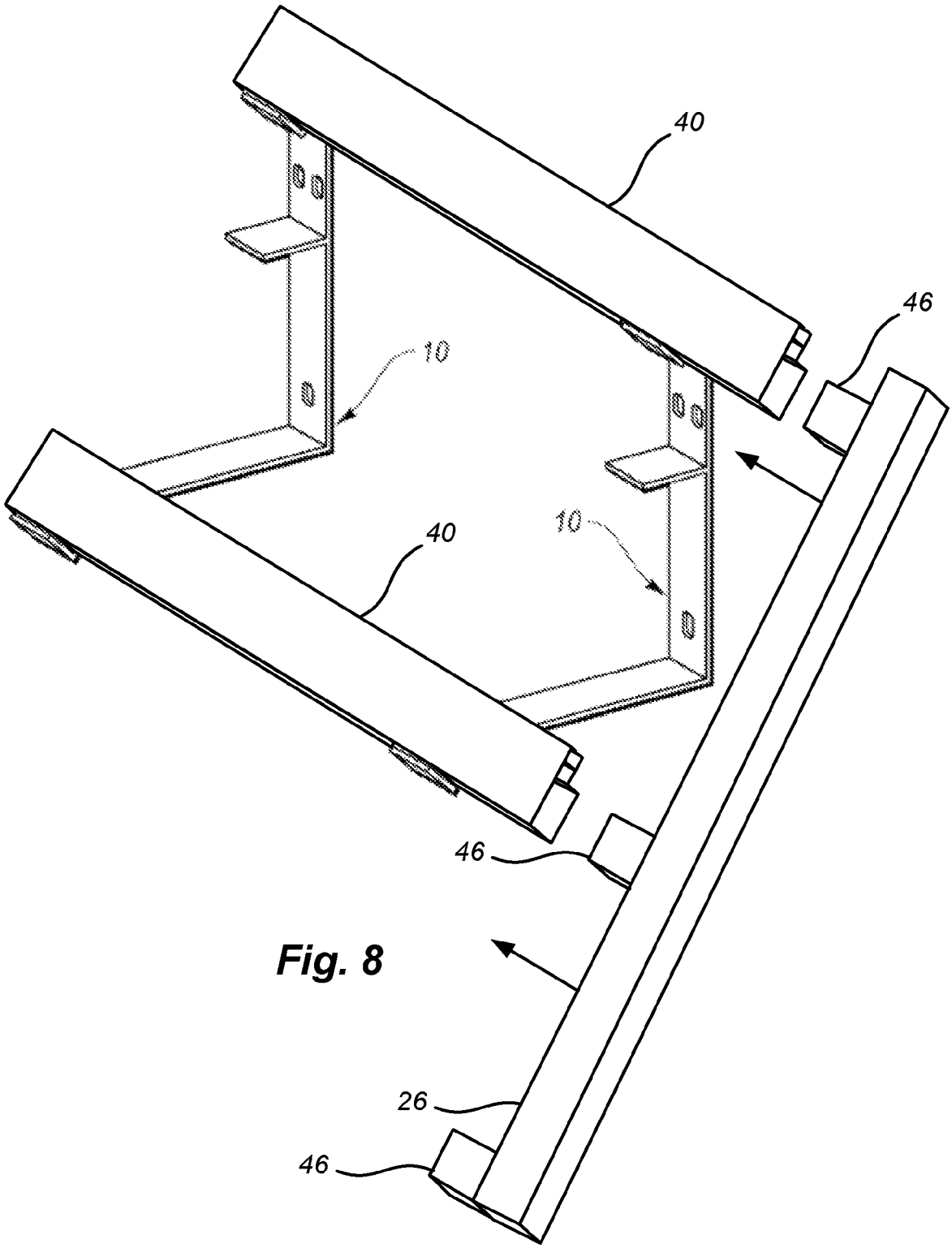
FIG. 8 is a perspective view showing embodiments of the awning brackets and the awning support members used in conjunction with the brackets, showing mechanisms and methods for assembly of an awning in accordance with embodiments of the invention.

The respective free ends 18, 20, of the bracket member legs 12, 16, may be L-shaped configurations having first downwardly-angled arms 22, in a common alignment illustrated by the theoretical line L, terminating in perpendicular arms 24. As best seen in FIG. 4 and FIG. 8 said free ends 18, 20 are used to secure awning support members 40 and an awning spar support 26 through fastener members 28. The awning spar support 26 and the support members 40 may be extruded aluminum. By the use of a pair of such bracket members 10, a single person can easily install the awning over a selected window or door. Additionally, as seen in FIG. 7, additional such bracket members 10 may be used to support an easily-installed awning over a wider window/door or over a plurality of windows and/or doors.

Further, to provide lighting to the underside of the awning, the vertically-oriented leg 12 is provided with an inwardly-directed leg 30, essentially parallel to said horizontally-oriented leg 16, from a midpoint 32 of the leg 12, where the inwardly directed leg 30 does not extend to the theoretical line L illustrating the alignment of downwardly-angled arms 22. Inwardly-directed legs 30 provide a means of mounting a light fixture, as is known in the art.

Figure 5:
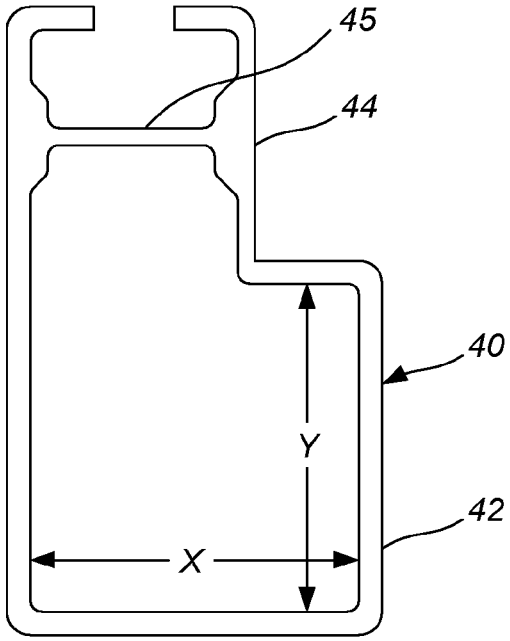
FIG. 5 is a cross-sectional or end view of an embodiment of a horizontal awning support member for positioning and securing to the bracket.
Figure 6:
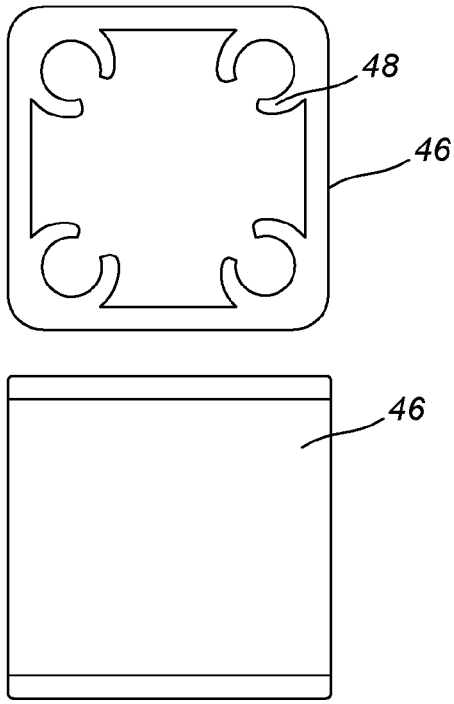
FIG. 6 includes a cross-sectional or end view and a side view of an embodiment of an end member, connecting block, or attachment block for snug sliding receipt in the horizontal awning support member.

FIG. 5 shows an end or cross-sectional view of a horizontally-disposed awning support member 40, and FIG. 6 shows both an end or cross-sectional view and a side view of one embodiment of a horizontally-disposed connecting block 46. The first said awning support member 40, FIG. 5, may comprise an aluminum extrusion of a length to extend at least the width of a window, see FIG. 7, having a first leg 42 with internal dimensions "X" and "Y," and may have a second smaller leg 44 extending therefrom, where the second smaller leg 44 may include a cross support rib 45. In some embodiments, the dimensions "X" and "Y" may be approximately equal. In embodiments where the second smaller leg 44 is present, the second smaller leg 44 may be used to receive a metal-piercing staple or other fastener to affix the awning material, skin, or cover (such as fabric or vinyl) to the awning frame, as will be illustrated later with respect to FIGS. 19-21, and may also be used to receive one or more fasteners to attach the awning support member 40 to the bracket member 10 or other support, as will be illustrated later with respect to FIG. 22.

The awning support member 40, and more specifically the first leg 42, is sized to seat within the bracket free ends 18, 20, one for the top and one for the bottom of the bracket member 10 with the awning support member 40 in any desired rotational orientation (i.e. with the second smaller leg 44 up or down). The connecting block 46, FIG. 6, may also comprise an aluminum extrusion and may be generally rectangular in cross-section having a width approximately equal to or slightly less than "X" and a height approximately equal to or slightly less than "Y," whereby it may be slidably and snugly received within said first leg 42 of said awning support member 40. The length of the connecting block 46 may be limited to a length sufficient to be secured within said first leg 42 and optionally may be extended to a length sufficient (potentially significantly longer than the length illustrated in FIG. 6) to also permit securing of said arms 22, 24 at said free ends 18, 20 to said connecting block 46 within said first leg 42 of said awning support member 40. Note that the connecting block 46 may include plural, arcuate arms 48 to define several screw bosses for securing the assembled first and second awning support members 40, 46 to the awning spar support 26, as will be described in more detail below.

Connecting block 46 provides means for securing the awning support members 40, the connecting block 46, and/or the awning spar support 26 to another extrusion member 50 (such as along the bottom edge of the awning) and/or to brackets 10. By mounting and securing a pair of the assembled awning support members 40 and connecting blocks 46 to a pair of said L-shaped brackets 10, support for the awning is firmly secured about its top and sides. Support for the awning may be further secured about its bottom edge by the further extrusion member 50 that may be similar in cross-section to the awning support member 40, or may have a square or rectangular cross-section with internal dimensions equal to "X" and "Y," as will be further appreciated below. The awning, along its upper and lower ends and along its mid section, may be stapled by metal piercing staples or other fastening members, as is known in the art.

FIG. 7 illustrates how the system of this invention may be mounted above a single or pair of doors and/or windows "W." FIG. 7 illustrates a plan view of assembled awnings, in which the awning material or awning skin, "A," has been partially cut away to show the frame members and bracket members 10 of the awning. The bracket members 10 may be attached to the building's wall either above or to the side of the window(s) and/or doors. Awning support members 40 are received by and attached to the free ends 18, 20 of two or more bracket members 10, with the awning support members 40 in a generally-horizontal position. As may be appreciated by one of skill in the art, the awning support members 40 may be sized to match a desired awning width on site, such as by cutting the awning support members 40 to length.

In FIG. 7, the rightmost awning is supported by two bracket members 10, while the leftmost awning, which spans two windows, is supported by four bracket members 10. Those of skill in the art will readily appreciate that any number of bracket members 10 may be used depending on the horizontal space to be spanned. The awning support members 40 may be located on the free ends 18, 20 in any desired rotational orientation. In addition, as set forth above, the cross-sectional shape of the awning support members 40 may be varied and still fall within the scope of the embodiments of the invention. It is anticipated that the cross-sectional shapes of the awning support members 40 may be approximately square, approximately rectangular, or any other shape that fulfils structural and/or aesthetic purposes. In other words, in some embodiments, the cross-sectional shapes of the awning support members 40 may include the first leg 42 without any corresponding second leg 44.

Figure 9:
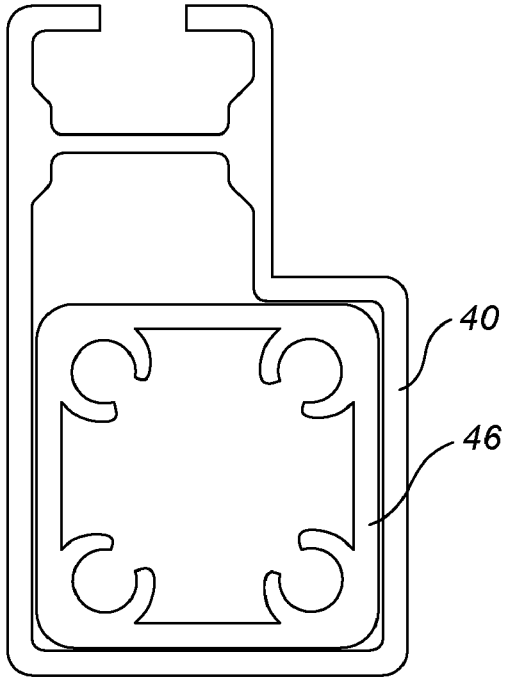
FIG. 9 shows a cross-sectional or end view of the embodiment of the awning support member of FIG. 5 containing the nested embodiment of the connecting block of FIG. 6, as may occur during assembly of some embodiments of the invention.
Figure 10:
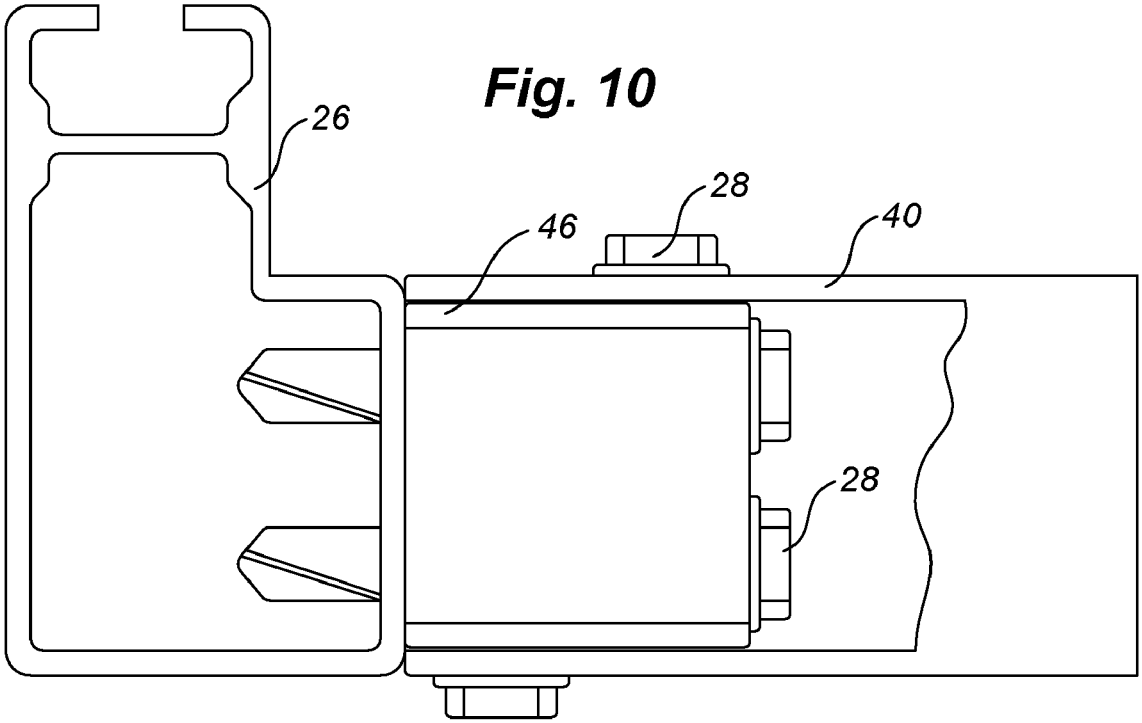
FIG. 10 illustrates a partial cutaway view of using awning support members, awning spar supports, and connecting blocks to assemble embodiments of awning frames.

An awning spar support 26 is attached at either end of the awning support members 40, using the connecting blocks 46, as is illustrated in FIGS. 8-10. FIG. 8 illustrates a perspective view of a pair of bracket members 10 as illustrated in FIG. 1, with a pair of horizontally-disposed awning support members 40 in the free ends 18, 20 of the bracket members 10. The elements illustrated in FIG. 8 are not to scale, but FIG. 8 is intended merely illustrate the principles of assembly and functions of the elements of embodiments of the invention. As may be appreciated from FIG. 8, the downwardly-angled arms 22 and the perpendicular arms 24 serve to easily align and locate the awning support members 40 during assembly of the awning. In FIG. 8, three connecting blocks 46 have been attached to the awning spar support 26. Two connecting blocks 46 have been attached at locations corresponding to the awning support members 40 (one near the top of the awning spar support 26, and one near the center of the awning spar support 26), and a third connecting block 46 has been attached near the lower end of the awning spar support, to provide a connection for the extrusion member 50 that serves to anchor the lower end of the awning. The exact placement of the connecting blocks 46 may be varied and still fall within the scope of the embodiments of the invention; for example, the placement may be varied to provide a bigger or smaller awning (i.e. one that extends farther from or less far from the building, structure, or wall to which the awning is attached).

The connecting blocks 46 may be secured to the awning spar support 26 by any means of securing known in the art, including fasteners such as self-tapping screws (a subset of fastener members 28) through the screw bosses formed by the arcuate arms 48. Once the connecting blocks 46 are secured to the awning spar support 26, the awning spar support 26 may be moved in the direction of the arrows in FIG. 8 relative to the awning support members 40 until the connecting blocks 46 enter into the awning support members 40. At that time, additional means for securing, such as self-tapping screws or other fastener members 28 may be used to permanently or reversibly secure the awning support members 40 to the connecting blocks 46, and thus to the awning spar support 26, as illustrated in FIG. 7. Assembly of the additional extrusion member 50 at the lower edge of the awning, and then a corresponding awning spar support 26 at the other end of the awning occurs similarly, as may be appreciated by one of skill in the art. As will also be appreciated by one of skill in the art, the length of the connecting block 46 may be lengthened, or the bracket members 10 may be disposed close to the awning spar support 26 to permit securing of the bracket members 10 to the connecting block 46 through the awning support members 40. Alternatively, the bracket members 10 may be secured to the awning support members 40 without being secured to the connecting blocks 46.

FIG. 9 illustrates one example of how the connecting block 46 is received into the end of the awning support member 40 (or, similarly, how the connecting block 46 is received into the additional extrusion member 50). FIG. 10 shows a detailed view of an example of the final connection between the various members of the awning support frame (not including the bracket members 10). The connecting block 46 is secured to the awning spar support 26 by fastener member(s) 28. The connecting block 46 is then received within the end of the awning support member 40 (or alternatively the extrusion member 50) as illustrated in FIGS. 8-9, and is secured by additional fastener member(s) 28, which may include screws, self-tapping screws, bolts and nuts, and/or rivets.

When the awning frame is assembled as depicted in FIG. 7, the awning skin material ("A") may be attached to the frame as illustrated in FIG. 7. The awning skin material may be any desired awning material known in the art or later invented, including cloth, aluminum, composites, and laminate materials. Additionally, the awning skin may comprise an additional frame and material, and may comprise a pre-assembled frame and material for mounting to the fully-assembled awning frame. If desired, sides may also be provided for the awning, and may be provided as integral members of the awning spar supports 26, or may alternatively be attached separately to the awning spar supports 26 and/or to the building, such as by fastener member(s) 28. In embodiments where the awning spans a large space, such as multiple windows, additional awning spar supports 26 may be located along the span for additional support (i.e. such as between the two windows of the leftmost awning illustrated in FIG. 7). In such embodiments, the connection between frame elements may be provided by attaching connecting blocks 46 to both sides of the intermediate awning spar supports 26, as will be appreciated by those skilled in the art.

As may be appreciated from the above description, assembly and disassembly of the awning may be readily accomplished on-site by a single handyman or installer with standard tools. As illustrated in FIGS. 8-10, the bracket members 10 may be mounted to the structure or building to receive the awning, the awning support members 40 may be rested in or attached to the bracket members, and the remaining portions of the awning frame may be assembled to the awning support members 40, as described. The awning skin may then be attached, along with any additional structures, such as awning sides. The reverse process may then be followed to disassemble the awning.

Alternatively, the awning frame may be assembled as described above, but on a flat horizontal surface to make assembly of the frame easier. The awning skin may also be attached to the frame at this stage. The entire assembled frame (and awning skin, if applicable) may then be lifted onto the mounted bracket members 10, and then attached to the bracket members 10, such as by fastener members 28. In still another example of a possible assembly sequence, the frame may be assembled and attached to the bracket members 10 on the ground, and the entire awning may then be lifted up and attached to the structure at the bracket members 10. Thus, it may be seen that the structure of the embodiments of the invention provide ease and flexibility of assembly of an awning. As set forth above and as will be appreciated by one of skill in the art, in some embodiments the awning support members 40, additional extrusion member(s) 50, the awning skin, and even the awning spar supports 26 may be cut to size/length on site to accommodate a smaller awning than the maximum size contemplated by the kit of components.

Figure 11:
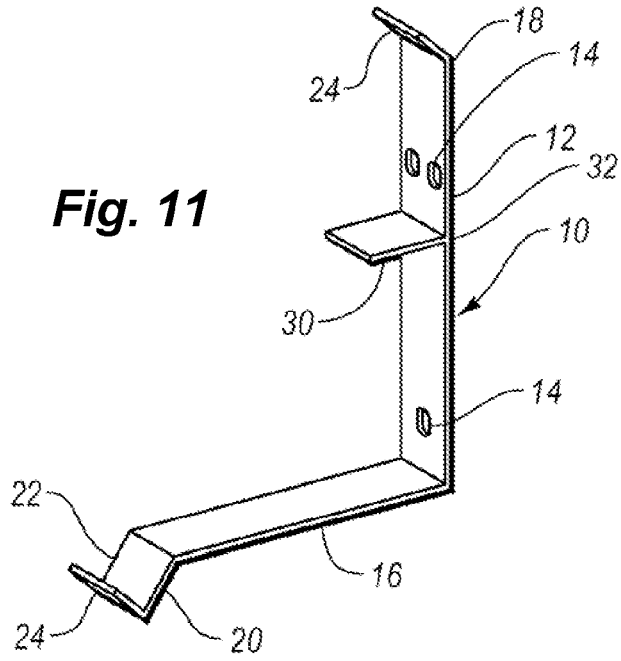
FIG. 11 is a perspective view of an alternate embodiment of an awning bracket according to embodiments of the invention.
Figure 12:
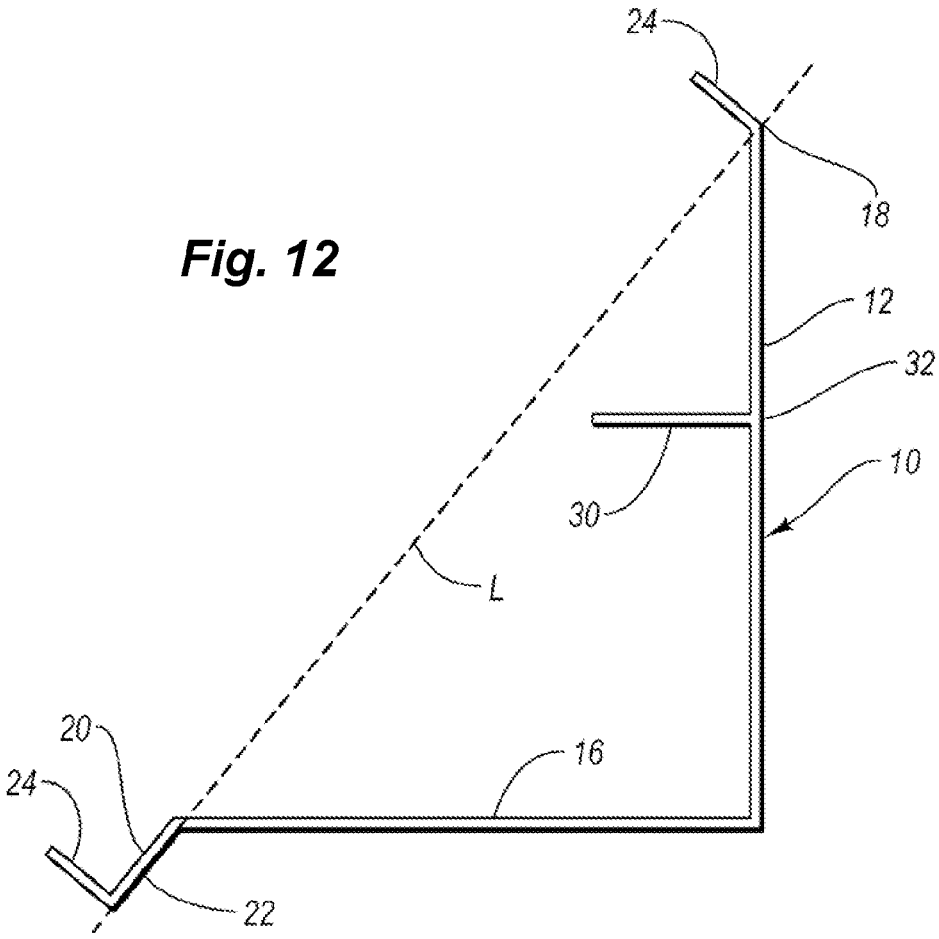
FIG. 12 is a side view of the awning bracket illustrated in FIG. 11.

FIGS. 11 and 12 depict an alternate embodiment of the bracket members 10 that may be used with embodiments of the present invention. In the illustrated embodiment, the free end 18 of the vertically-oriented leg 12 does not include a downwardly-angled arm 22. Instead, the perpendicular arm 24 extends directly from the free end 18 of the vertically-oriented leg 12. In this embodiment, the perpendicular arm 24 attached to the vertically-oriented leg 12 is still substantially perpendicular to the theoretical line "L," as is the perpendicular arm 24 of the horizontally-oriented leg 16 (compare FIGS. 2 and 12), and the arrangement of the other parts of the awning frame is substantially similar to that described above. In still other alternate embodiments, the perpendicular arm 24 may be directly attached to the horizontally-oriented leg 12 without a downwardly-angled arm in addition to or alternatively to the perpendicular arm 24 being directly attached to the vertically-oriented leg. In still other embodiments, one or more of the perpendicular arms 24 may be omitted and the awning support members may be secured directly to the downwardly-angled arm(s).

Figure 13:
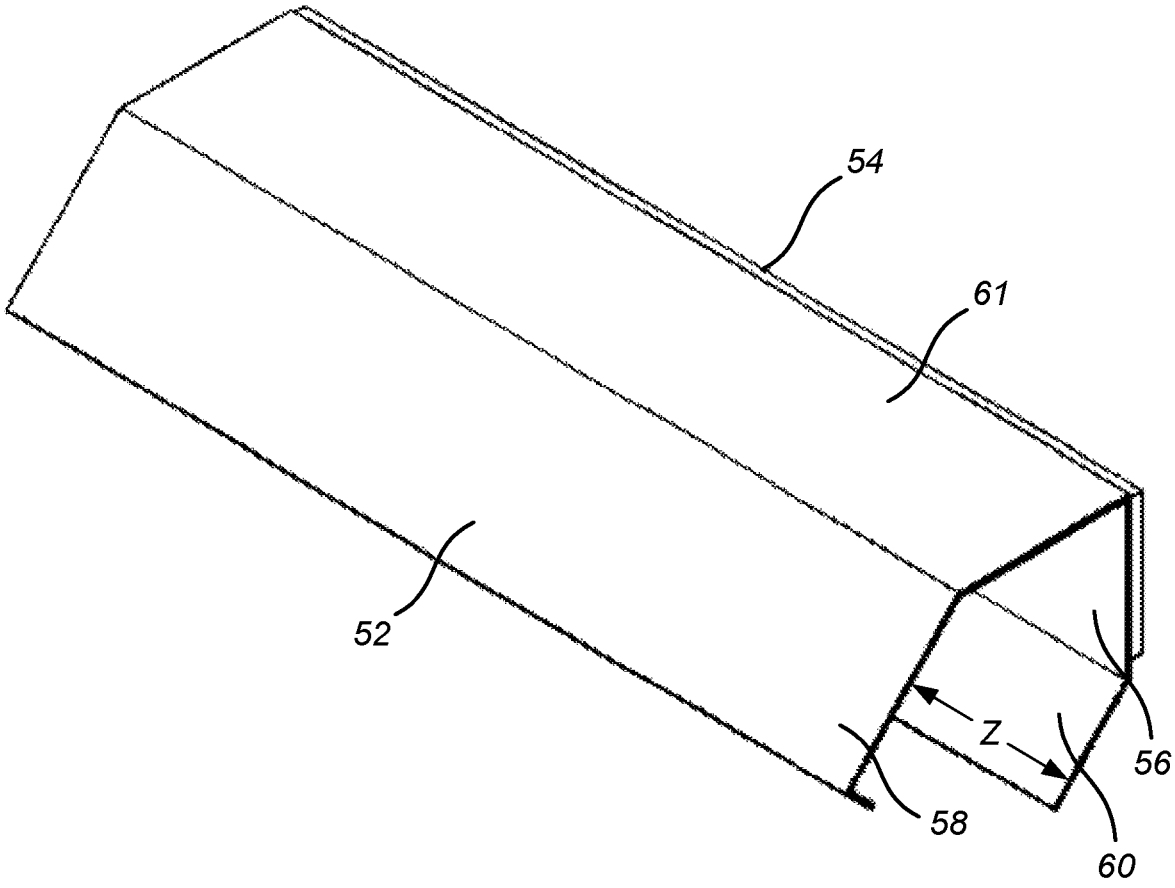
FIG. 13 is a perspective view of a section of flashing for use with embodiments of the invention.
Figure 14:
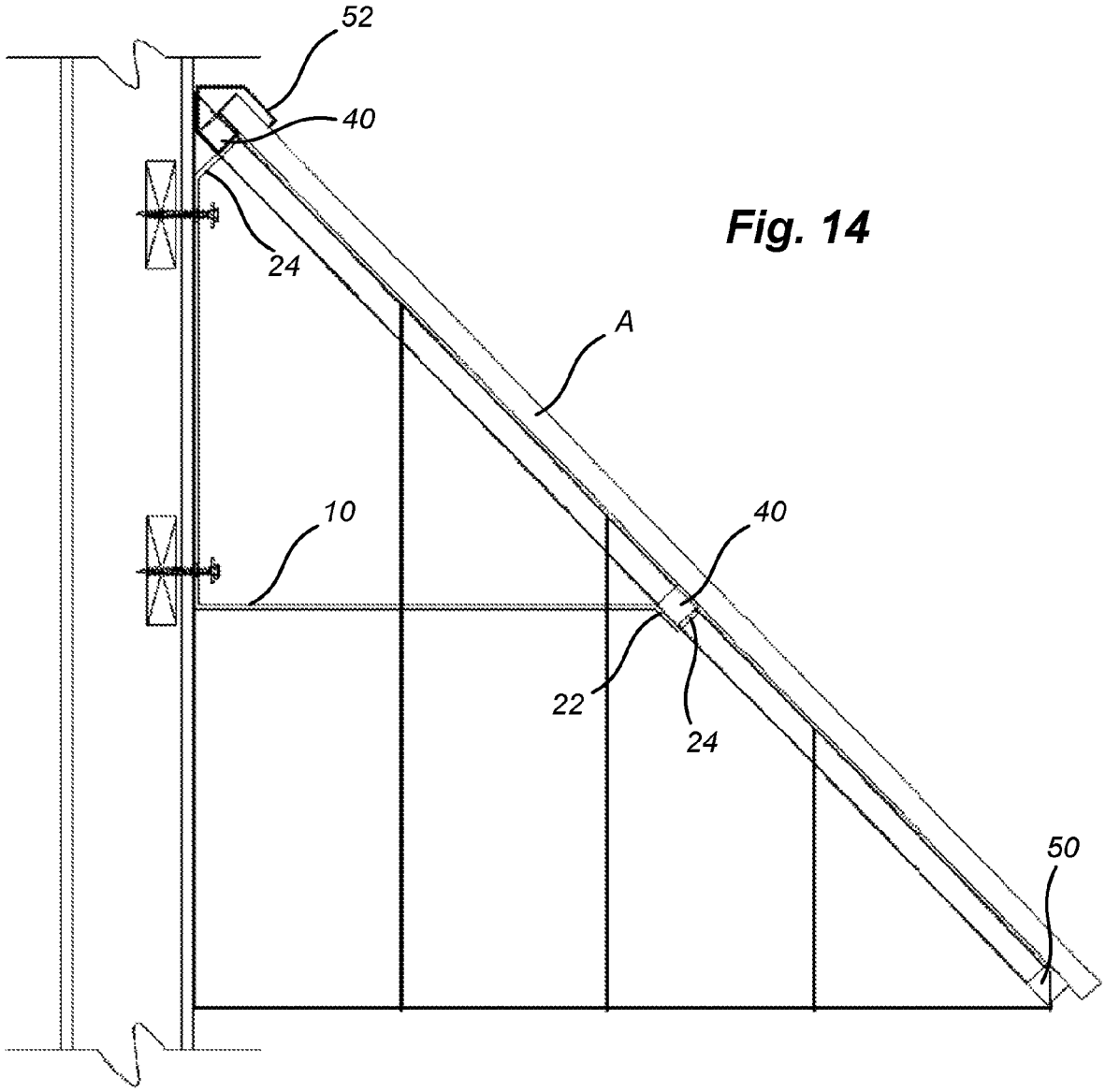
FIG. 14 is a side plan view of an assembled awning including the embodiment of the awning bracket of FIG. 11 and the embodiment of the flashing of FIG. 13.
Figure 15:
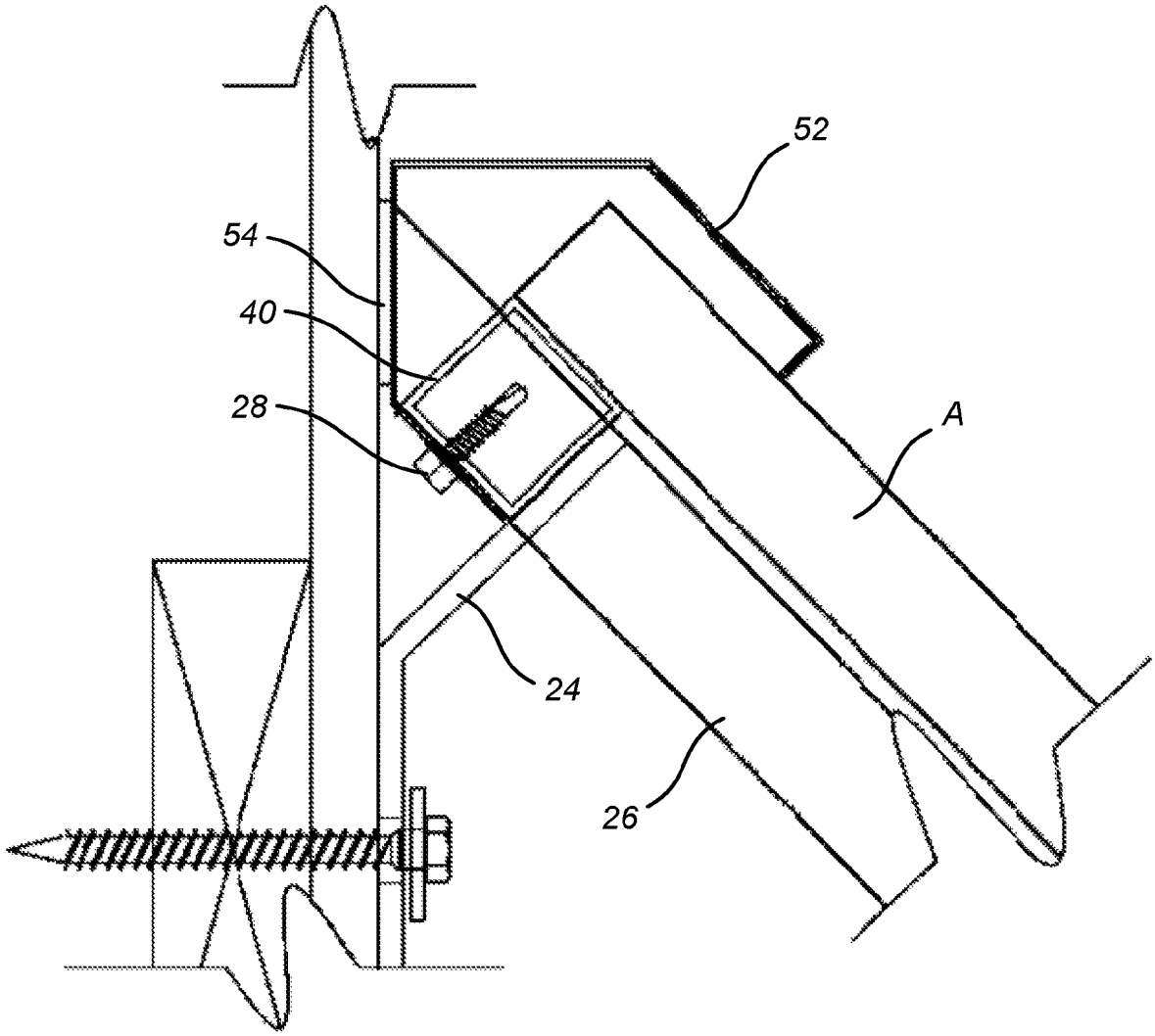
FIG. 15 is a close-up plan view of the embodiment of FIG. 14.

In some embodiments of the invention, a flashing may be provided to reduce or prevent moisture from passing behind the top of the awning, as illustrated in FIGS. 13-15. FIG. 13 illustrates an embodiment of such a flashing 52. The flashing 52 may include weather stripping 54 to be disposed against the wall of the building, to seal the awning against the wall and prevent the entry of moisture behind the awning next to the building. FIG. 14 illustrates a side plan view of an assembled awning according to the embodiment of the bracket member 10 illustrated in FIGS. 11-12, including the flashing 52 illustrated in FIG. 13. In the illustrated embodiment, the awning support members 40 and the additional extrusion member 50 have an approximately-square cross-section.

FIG. 15 shows a close-up view of the embodiment of FIG. 14, better showing the function of the flashing 52 in sealing the top of the awning. As is seen in FIG. 15, the flashing 52 may be attached to the uppermost awning support member 40 by fastener members 28. The flashing 52 may be of a substantially-rigid material, such as aluminum, and may therefore be secured to the upper awning support member 40 by fastener members 28 having a spacing of several inches to several feet, as the flashing is not typically exposed to strong forces.

As is shown in FIG. 13-15, the flashing 52 includes a substantially-vertical portion 56 that conforms to the wall or structure to which the awning is mounted, and which secures the weather stripping 54, if present. The flashing 52 also includes front angled portion 58 and back angled portion 60, which are separated by a distance "Z" that may correspond to the thickness of the awning frame (i.e. awning support member 40) and awning skin, as illustrated in FIGS. 14 and 15. This distance "Z" prevents wind-blown rain or snow from passing up under the flashing 52, as the front edge of the flashing 52 rests close to or adjacent the awning skin when the back angled portion 60 is secured to the upper awning support member 40. The flashing 52 may also include a substantially-horizontal portion 61, as illustrated in FIGS. 13-15, or the vertical portion 56 and the front angled portion 58 may be extended vertically to meet each other for aesthetic or other reasons. The horizontal portion 61 may also be replaced with an additional angled portion having an angle different than the front angled portion 58, for aesthetic or other purposes.

Figure 16:
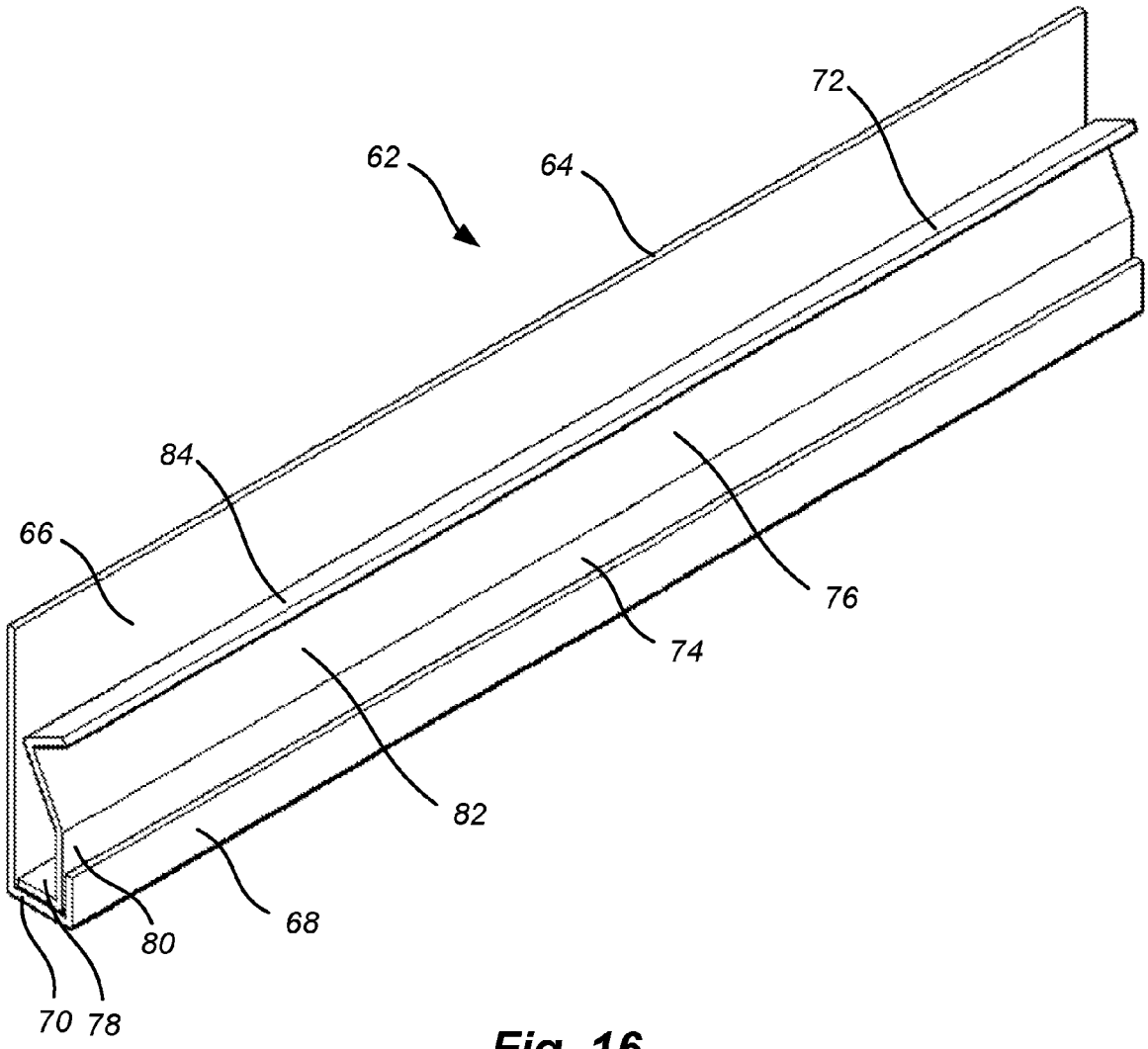
FIG. 16 is a perspective view of a section of an embodiment of an awning support structure in accordance with some embodiments of the invention.
Figure 17:
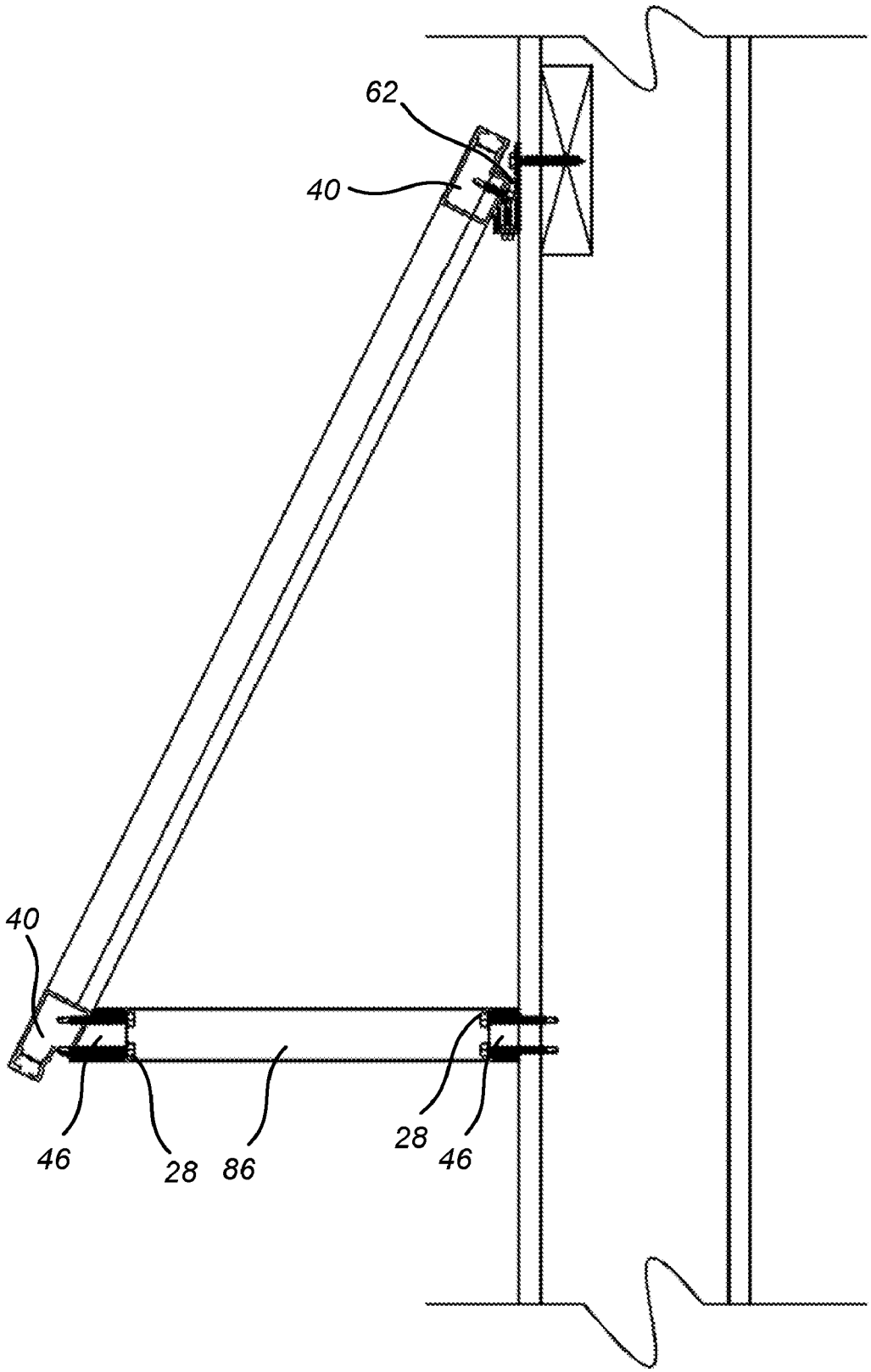
FIG. 17 is a side plan view of an assembled awning including the embodiment of the awning support structure of FIG. 16.
Figure 18:
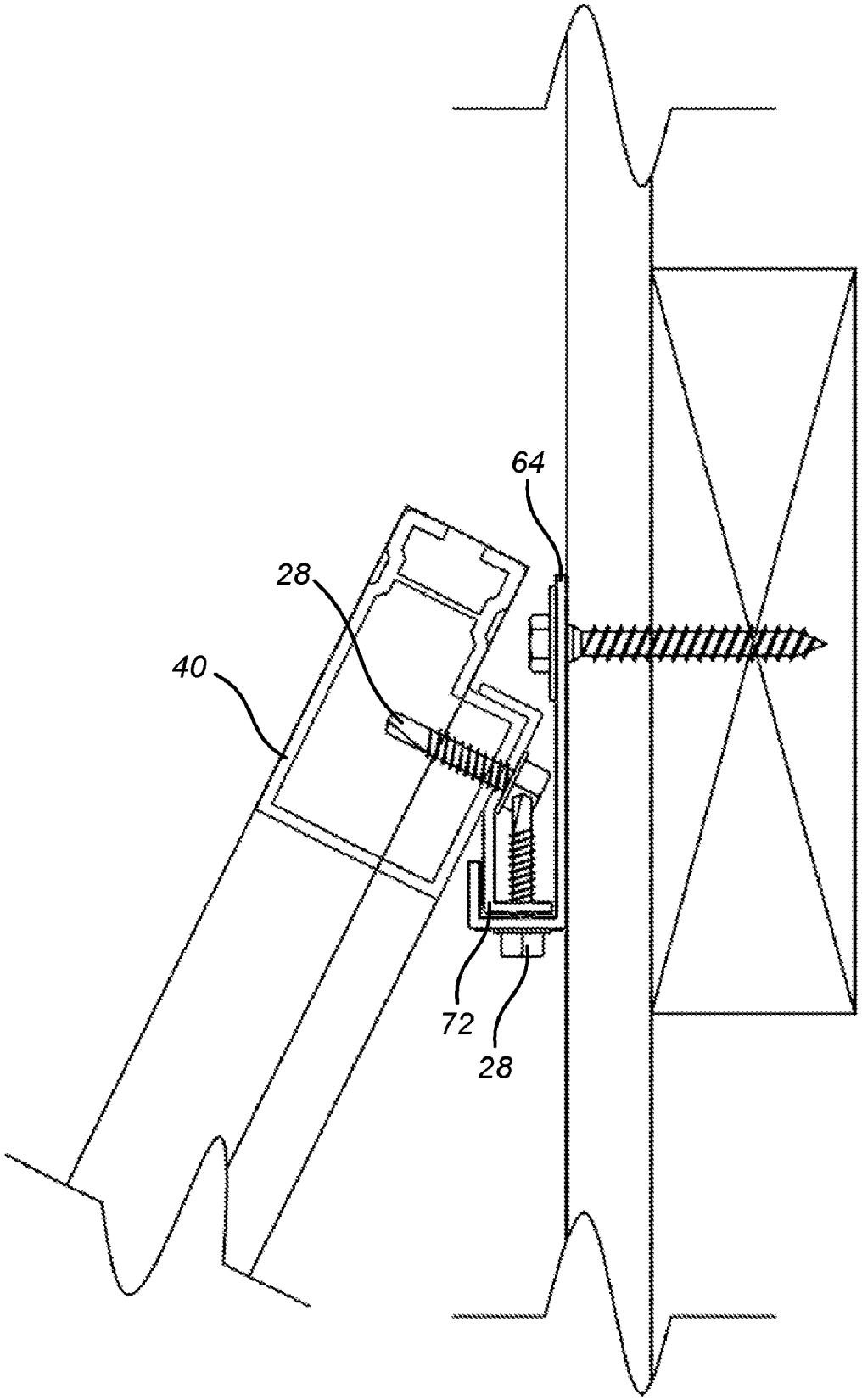
FIG. 18 is a close-up plan view of the embodiment of FIG. 17.

In some embodiments of the invention, the moisture-stopping functions of the flashing 52 and the weight-bearing support functions of the bracket members 10 may be combined, as is illustrated in FIGS. 16-18. In these embodiments, the awning frame (including awning support member(s), additional extrusion member(s), awning spar supports 26, and connecting blocks 46) may be assembled in similar fashion to that described above with regards to FIGS. 5-10, with the bracket members 10 being omitted and replaced as described below.

FIG. 16 shows a support structure 62 that supports the weight of an awning and also provides for dispersal of water to the sides of the awning, including water running down a wall or other structure from above the awning. The support structure 62 includes a support channel 64 that may be mounted directly to a wall. The support channel 64 may have a "U" shape or cross-section, with one arm of the "U" shape partially truncated, as may be seen in FIG. 16. A higher arm 66 of the "U" shape provides a surface to receive fasteners such as fastener members 28 (which may be lag bolts or other fasteners, as is known in the art) for mounting the support structure 62 to the wall. A lower arm 68 prevents water entering the channel formed by the higher arm 66, the lower arm 68, and a horizontal arm 70 connecting the higher arm 66 and the lower arm 68 from flowing forward and under the awning. Thus, water that enters the channel from above is directed to the sides of the awning by the support channel 64.

The support channel 64 may receive an awning mounting member 72 that is configured to be mounted to the awning frame and to rest in and be attached to the support channel 64. The support channel 64 and the awning mounting member 72 form the support structure 62. The support channel 64 and the awning mounting member 72 may be of any material known in the art to have sufficient strength and durability to perform the functions recited herein, including aluminum, whether extruded aluminum or bent or formed sheet aluminum, stainless or painted steel, and other painted or unpainted metals and alloys. In some instances, plastics or plastic-coated metals may be used for the support channel 64 and the awning mounting member 72.

The awning mounting member 72 may include a first portion 74 configured to mate with, rest in, and be mounted to the support channel 64. In the embodiment illustrated in FIG. 16, the first portion 74 includes a substantially-horizontal portion 78 that rests on the horizontal arm 70 and a substantially-vertical portion 80 that generally touches and rests against the interior side of the lower arm 68. The first portion 74 may be sized so as to be snugly secured in the support channel 64, as illustrated in FIGS. 16 and 18.

As may be appreciated by reference to FIG. 18, the horizontal arm 70 and the horizontal portion 78 provide a mechanism whereby the support channel 64 and the awning mounting member 72 may be connected together. For example, these structures may be connected together by any means known in the art, including adhesives and fasteners. By way of example and illustration, FIG. 18 shows the connection being made by way of fastener members 28. To aid in the water-dispersing function of the support channel 64, a sealant such as weather stripping may be disposed between the support channel 64 and the first portion 74 of the awning mounting member 72, effectively increasing the water-conducting volume of the support channel 64, as will be appreciated by one of skill in the art.

The awning mounting member 72 also includes an awning-connecting portion 76 configured to attach to the frame of the awning, as illustrated in FIGS. 17 and 18. Although the awning-connecting portion 76 may take any desired shape so as to mate with the awning frame, FIGS. 16-18 show an embodiment having a first angled portion 82 and a second angled portion 84. The first angled portion 82 and the second angled portion 84 conform to the shape of the awning frame, as illustrated best in FIG. 18, and provide surfaces and structures for connecting the awning mounting member 72 to the awning frame (i.e. the upper awning support member 40), such as by fastener members 28. As may be appreciated by one of skill in the art, one or more surfaces of the support channel 64 and/or the awning mounting member 72 may be provided with weather stripping, some other sealant, or any other means known in the art for sealing the awning to the awning mounting member 72, the awning mounting member 72 to the support channel 64, and the support channel 64 to the structure supporting the awning, to prevent water leakage. In addition, as may be appreciated by one of skill in the art, the awning mounting member 72 may be further extended to surround the top portion of the awning frame, in the manner of the flashing 52 illustrated in FIGS. 13-15.

The support structure 62 may support the bulk of the weight of the mounted awning, but as will be appreciated by one of skill in the art, the support structure 62 generally provides only minimal support for keeping the lower portion of the awning away from the building or other structure to which the awning is mounted (i.e. keeping the awning at the proper angle). Therefore, in embodiments where the support structure 62 is used, one or more awning projection props 86 may be used at a midpoint or lower portion of the awning frame, as illustrated in FIG. 17, at a location corresponding to an awning support member 40 or other extrusion member 50, or to a location somewhere along the awning spar support 26.

The awning projection prop 86 may be an extruded aluminum member of any cross-sectional shape, and may be attached to the wall and to the frame of the awning in similar manner to that discussed above with respect to FIGS. 8-10. Thus, a connecting block 46 may be attached to the wall and to the frame element (awning support member 40, additional extrusion member 50, or awning spar support 26) using fastening means such as fastener members 28. If necessary, one or both connecting blocks 46 may be formed or cut on an angle corresponding to the angle of incidence between the awning projection prop 86 and the wall or frame element, as will be appreciated by one of skill in the art. The awning projection prop 86 may then receive the connecting blocks 46 in either end and be secured to the connecting blocks 46 by further fastener members 28 or other fastening means, such as rivets, as described above in detail. In some embodiments, the awning projection props 86 may be incorporated into or formed with a side of the awning, or may be replaced by an awning side that is sufficiently rigid to perform the functions of the awning projection props 86.

As will be appreciated from the above discussion, assembly of such embodiments of the invention is also readily performed on site by a handyman or single installer using standard tools. The awning frame may be assembled in the manner discussed above with respect to FIGS. 8-10, with assembly occurring on a flat horizontal surface, such as on the ground. The awning mounting member 72 and connecting blocks 46 for the awning projection props 86 may then be mounted to the awning frame, along with the awning skin and any awning sides, if desired. The support channel 64 and the building-side connecting blocks 46 may then be attached to the building at the desired locations, and the assembled awning frame may be lifted up until the awning mounting member rests within the support channel 64. The bottom of the awning may then be lifted away from the building as the awning projection props 86 (or other elements performing the function of the projection props 86) are placed to receive and engage the connecting blocks 46 and then the fastener members 28 or other fastening means may be used to secure all connections. Disassembly easily occurs by reversing the process.

Alternatively, the awning support members 40 may be assembled to the support structure 62 and the awning projection props 86 and mounted to the building, and the awning spar supports 26 may then be attached, as per FIGS. 8-10, in situ. The awning skin and any additional structure such as awning sides may then be attached as described above to complete the awning on the building. Thus, in this and similar manners, the described embodiments permit simple, quick, and effective installation of an awning by a handyman or other moderately-skilled person using standard tools.

FIGS. 19-22 provide illustrations of mechanisms of attachment of the awning skin to an illustrated embodiment of the awning support member 40 and of the illustrated embodiment of the awning support member 40 to the downwardly-angled arm 22 and perpendicular arm 24 of the bracket member 10. The illustrations are by way of example only, and one of skill in the art will readily appreciate that other shapes of the awning support member 40 may be used along with other awning skins and attachment mechanisms, and still fall within the scope of the embodiments of the invention, as contained in the appended claims.

Figure 19:
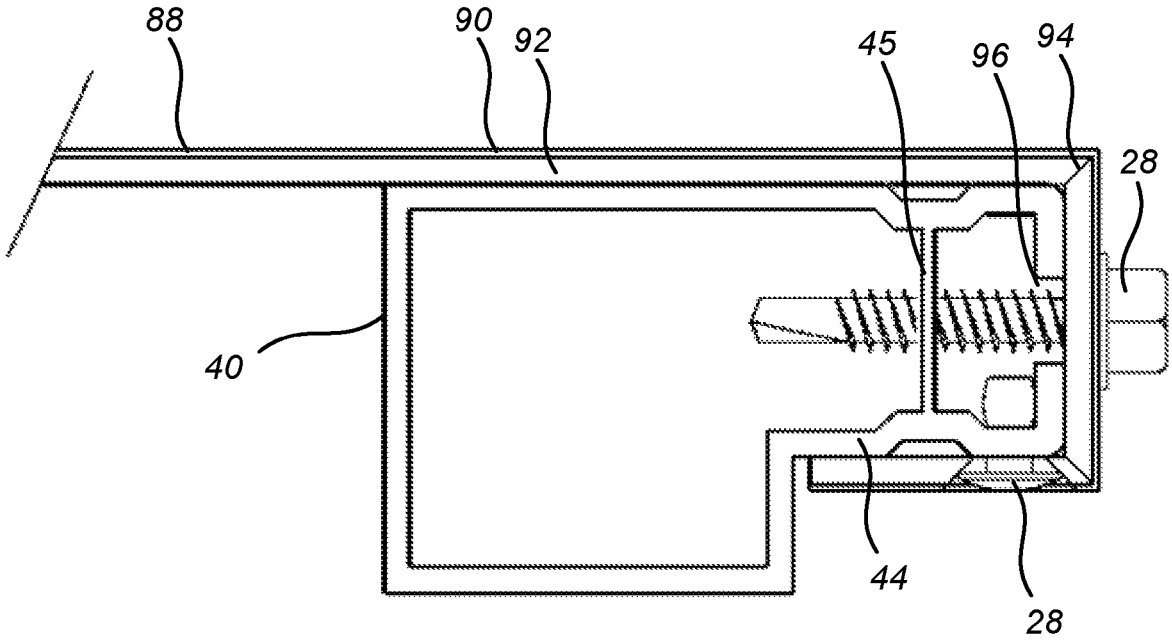
FIG. 19 is a plan view showing one method of attaching an awning skin to an awning support member.

FIG. 19 illustrates one method of attaching a composite awning skin 88 to the awning support member 40. As may be appreciated from the above discussion, the awning support member may be mounted to other frame members and/or to support structures on or off of the structure wall prior to or after the awning skin such as the composite awning skin 88 illustrated in FIG. 19 is attached to the awning support member 40. The composite awning skin 88 is illustrated as having two layers, an outer layer 90 and an inner layer 92. In some embodiments, the outer layer 90 may be aluminum, copper, stainless steel, or other metals or alloys, and the inner layer 92 may be plastic such as polyethylene or fluoropolymer resins such as Lumiflon® utilized by Mitsubishi Chemical Functional Products, Inc, one manufacturer of composite awning skins 88, which manufactures Alpolic®-brand composite materials. One of skill in the art will readily recognize the great number of two-layer, three-layer, and other multi-layer composite materials that may be used in embodiments of the invention for the awning skin, including the various Alpolic® materials available.

The composite awning skin 88 may be attached to the smaller leg 44 of the awning support member 40 using fastener members 28, as is illustrated in FIG. 19. To facilitate such attachment, one or more layers of the composite awning skin 88 may be routed out at, for example, 45-degree angles to provide routed corner bends 94 to contour the composite awning skin 88 to the contours of the awning support member 40. In the illustrated embodiment, one fastener member 28, illustrated as a self-tapping screw, passes through the composite awning skin 88 and an opening 96 in the smaller leg 44 to engage the cross support rib 45. The second fastener member 28, illustrated as a rivet, which may be an aluminum rivet to resist corrosion, may be countersunk into the composite awning skin 88 and attached to a side of the smaller leg 44. In this manner, the composite awning skin 88 is securely attached to the awning support member 40, or other frame member. As discussed above, the awning spar support 26 and the additional extrusion member 50 may have similar cross-sectional profiles to the awning support member 40.

Figure 20:
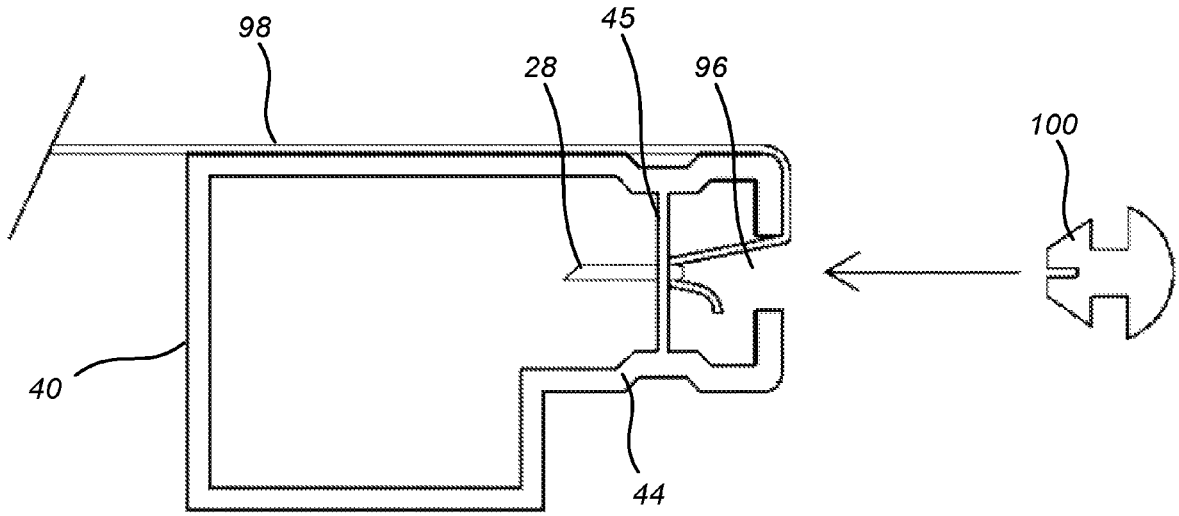
FIG. 20 is a plan view of an alternate method of attaching an awning skin to an awning support member.

FIG. 20 illustrates one method of attaching a vinyl or fabric awning skin 98 to the awning support member 40. The vinyl or fabric awning skin 98 may be stretched over the awning support member 40 (whether fully assembled as part of an awning frame or not), and a fastener member 28 may be used to secure the vinyl or fabric awning skin 98 to the awning support member 40. By way of example, the fastener member 28 may be a metal-piercing staple that is affixed to the cross support rib 45 of the smaller leg 44, in the manner illustrated in FIG. 20. An elongated trip cap 100 may then be inserted into the opening 96, thus hiding the attachment of the awning skin 98 to the awning support member 40 (or other awning frame element).

Figure 21:
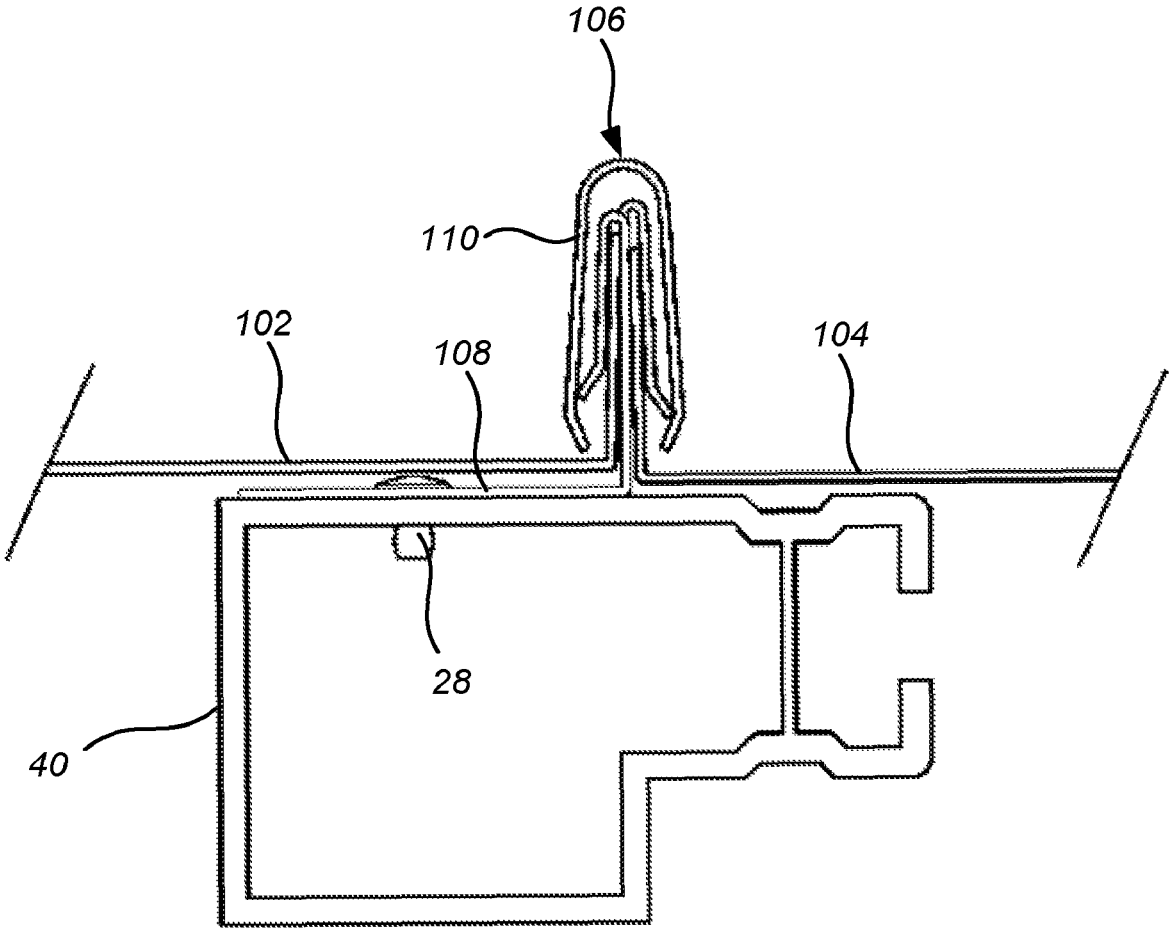
FIG. 21 is a plan view of an alternate method of attaching an awning skin to an awning support member.

FIG. 21 illustrates one method of attaching an aluminum awning skin 102 to the awning support member 40. In alternate embodiments, the aluminum awning skin 102 may be replaced with other metals such as copper, stainless steel, or alloys, and may be painted or non-painted. In addition, FIG. 21 illustrates a mechanism for simultaneously joining the aluminum awning skin 102 (or other metal skin) to an aluminum roof panel 104 (or other metal roof panel) at a standing seam 106 using a standing seam fastener clip 108 and a batten cap. The standing seam fastener clip 108 may be attached to the awning support member 40 (or other awning frame element) using a fastener member 28 (illustrated in FIG. 21 as being a rivet, such as an aluminum rivet). The standing seam fastener clip 108 receives the end of the aluminum awning skin 102 and the end of the aluminum roof panel 104 in a vertically-oriented fashion, as illustrated in FIG. 21, and then the batten cap 110 is placed over the joint to finish the standing seam 106. One of skill in the art will readily appreciate that the awning support member 40 may be rotated any desired amount about the fastener member 28, such as forty-five or ninety degrees, to achieve an angled standing seam 106 at a desired angle other than that illustrated in FIG. 21.

Figure 22:
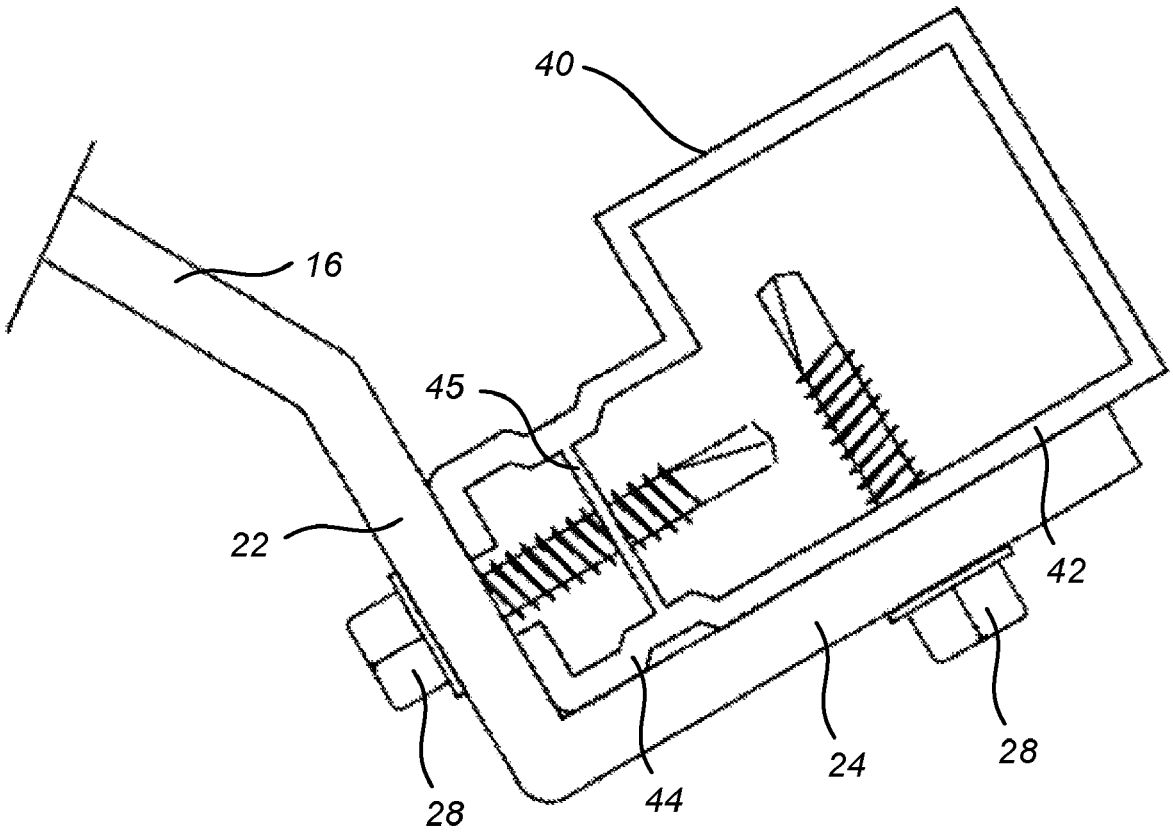
FIG. 22 is a plan view showing one method of attaching an awning support member to an awning bracket.

FIG. 22 illustrates one orientation in which the awning support member 40 may be attached to the downwardly-angled arms 22 and the perpendicular arms 24 of one of the free ends 18, 20, of the bracket member 10. By way of example, the illustration of FIG. 22 may be in the free end 20 of the horizontally-oriented leg 16. If the awning support member 40 is in the center of the awning, the structure provided by the smaller leg 44 may not be utilized for attaching an awning skin. The awning support member 40 may be oriented as shown, and the smaller leg 44 may be used to provide an additional attachment between the bracket member 10 and the awning support member 40, as shown in FIG. 22. In FIG. 22, one fastener member 28 passes through the perpendicular arm 24 into the first leg 42 of the awning support member, and the other fastener member 28 passes through the downwardly-angled arm 22, through the opening 96 and into the cross support rib 45 of the smaller leg 44. As set forth above, the rotational orientations of the awning support member 40 shown in FIGS. 8 and 22 are merely illustrative of the potential orientations, and other rotations may be used and still fall within the embodiments of the invention.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. An awning and light support system for mounting an awning to provide partial protection to an opening of a structure, said system comprising:
- at least two L-shaped brackets, each bracket comprising:
  - a first leg, comprising a first end and a second end;
  - a second leg, comprising a first end and a second end, wherein the first end of the second leg is perpendicularly coupled to the first end of the first leg;
  - a first support member, comprising:
    - a first arm coupled to the second end of the first leg but not perpendicular to or inline with the first leg; and
    - a second arm perpendicularly coupled to the first arm of the first support member; and
  - a second support member, comprising a first arm coupled to the second end of the second leg, but not perpendicular to or inline with the second leg, and wherein the first arm of the second support member is substantially parallel to one of:
    - the first arm of the first support member; and
    - the second arm of the first support member;
- a first horizontally-disposed elongate awning support configured to be attached to and to extend between the first support members of the respective brackets; and
- a second horizontally-disposed elongate awning support configured to be attached to and to extend between the second support members of the respective brackets.

2. The awning and light support system of claim 1, wherein the L-shaped brackets further comprise an inwardly-directed leg substantially perpendicularly coupled to one of the first leg and the second leg.

3. The awning and light support system of claim 1, wherein the second leg is substantially vertically oriented.

4. The awning and light support system of claim 1, further comprising an awning spar support configured to be attached at the ends of the first and second elongate awning supports.

5. The awning and light support system of claim 4, further comprising connecting blocks that are configured to be attached to the awning spar support and that are sized to be slidingly and snugly received within the first and second elongate awning supports.

6. The awning and light support system of claim 5, wherein the first and second elongate awning supports, the awning spar support, and the connecting blocks are extruded aluminum.

7. The awning and light support system of claim 1, wherein the first and second elongate awning supports are extrusion members comprising:
- a first leg sized to slidingly and snugly receive a connection block connected to an awning spar support; and
- a second smaller leg having a cross support rib.

8. An awning support system for mounting an awning to provide partial protection to an opening of a structure comprising:
- an awning frame comprising:
  - a plurality of elongate awning supports, each elongate awning support comprising a hollow, enclosed tube structure with open ends and having, in cross section, a first leg having internal dimensions sized to slidingly and snugly receive a connecting block inserted into one of the open ends, and wherein at least one of the elongate awning supports comprises, in cross section, a second smaller leg adjacent the first leg;
  - a plurality of elongate spar supports; and
  - a plurality of the connecting blocks attached to the spar supports and slidingly and snugly received within and attached to the first leg of the elongate awning supports.

9. The awning support system of claim 8, wherein the connecting blocks include a plurality of screw bosses formed by complementary arcuate pairs of arms for engaging a fastener.

10. The awning support system of claim 8, wherein the second smaller leg comprises a cross support rib.

11. The awning support system of claim 8, further comprising an awning skin attached to the awning frame.

12. The awning support system of claim 8, further comprising means for securing the awning frame to a wall of the structure.

13. The awning support system of claim 12, wherein the means for securing the awning frame to the wall comprises:
- at least two L-shaped brackets, each bracket comprising:
  - a first leg, comprising a first end and a second end;
  - a second leg, comprising a first end and a second end, wherein the first end of the second leg is perpendicularly coupled to the first end of the first leg;
  - a first support member, comprising:
    - a first arm coupled to the second end of the first leg but not perpendicular to or inline with the first leg; and
    - a second arm perpendicularly coupled to the first arm of the first support member; and
  - a second support member, comprising a first arm coupled to the second end of the second leg, but not perpendicular to or inline with the second leg, and wherein the first arm of the second support member is substantially parallel to one of:
    - the first arm of the first support member; and
    - the second arm of the first support member.

14. The awning support system of claim 12, wherein the means for securing the awning frame to the wall comprises:
- a support channel configured to be attached to the wall and to receive and be secured to an awning mounting member; and
- the awning mounting member, wherein the awning mounting member is configured to be attached to an uppermost one of the elongate awning supports and to rest in and be secured to the support channel.

15. The awning support system of claim 14, wherein the means for securing the awning frame to the wall further comprises awning projection props attached to the wall and to the awning frame at an intermediate or lower portion of the awning frame.

16. An awning support system for mounting an awning to provide partial protection to an opening of a structure comprising: an awning frame comprising:
- a plurality of elongate awning supports, each elongate awning support comprising a first leg having internal dimensions sized to slidingly and snugly receive a connecting block:

a plurality of elongate spar supports; and a plurality of the connecting blocks attached to the spar supports and slidingly and snugly received within and attached to the first leg of the elongate awning supports; and means for securing the awning frame to a wall of the structure comprising:

first additional connecting blocks attached to the wall;

second additional connecting blocks attached to the awning frame at an intermediate or lower portion of the awning frame; and awning projection props attached to the first additional connecting blocks and the second additional connecting blocks.

17. The awning support system of claim 8, further comprising:

a support channel configured to be attached to a wall of the structure and to receive and be secured to an awning mounting member;

the awning mounting member, wherein the awning mounting member is configured to be attached to an uppermost one of the elongate awning supports and to rest in and be secured to the support channel; and awning projection props attached to the wall and to the awning frame at an intermediate or lower portion of the awning frame.

18. The awning support system of claim 8, further comprising:

at least two L-shaped brackets, each bracket comprising:

a first leg, comprising a first end and a second end;

a second leg, comprising a first end and a second end, wherein the first end of the second leg is perpendicularly coupled to the first end of the first leg;

a first support member, comprising:

a first arm coupled to the second end of the first leg but not perpendicular to or inline with the first leg; and a second arm perpendicularly coupled to the first arm of the first support member; and a second support member, comprising a first arm coupled to the second end of the second leg, but not perpendicular to or inline with the second leg, and wherein the first arm of the second support member is substantially parallel to one of:

the first arm of the first support member; and the second arm of the first support member.

19. The awning support system of claim 8, further comprising a flashing secured at an upper portion of the awning support system to prevent water from passing behind the awning from above the awning.

20. An awning support system for mounting an awning to provide partial protection to an opening of a structure comprising:

an awning frame comprising:

a plurality of elongate awning supports, each elongate awning support comprising a first leg having internal dimensions sized to slidingly and snugly receive a connecting block;

a plurality of elongate spar supports; and a plurality of the connecting blocks configured to be attached to the spar supports and to be slidingly and snugly received within and attached to the first leg of the elongate awning supports;

an elongate support channel consisting essentially of a vertically-disposed higher arm of a first height connected at a lower edge to a horizontal arm that is also connected to a lower edge of a vertically-disposed lower arm of a second height smaller than the first height, the elongate support channel being configured to be attached to the structure at the higher arm and to receive and be secured to an awning mounting member; and the awning mounting member, wherein the awning mounting member is configured to be attached to an uppermost one of the elongate awning supports and to rest in and be secured to the support channel.

21. The awning support system of claim 20, further comprising awning projection props attached to the wall and to the awning frame at an intermediate or lower portion of the awning frame.

22. The awning support system of claim 20, wherein the elongate support channel is configured to disperse water from above the awning to either side of the awning.

23. The awning support system of claim 20, further comprising:

first additional connecting blocks attached to the wall and received within and attached to a first end of the awning projection props; and second additional connecting blocks attached to the awning frame at the intermediate or lower portion of the awning frame and received within and attached to a second end of the awning projection props.

24. The awning support system of claim 20, wherein one or more of the elongate awning supports further comprises a second smaller leg having a cross support rib.

25. The awning support system of claim 20, wherein the awning mounting member is an elongate member comprising:

a substantially-horizontal portion configured to rest on the horizontal arm of the support channel;

a substantially-vertical portion connected at its lower edge to an edge of the substantially-horizontal portion and configured to abut an inner surface of the lower arm of the support channel; and an awning-connecting portion connected to an upper edge of the substantially-vertical portion and shaped to mate with an upper portion of the awning frame.

* * * * *